US007808444B2

(12) United States Patent
Eriksson et al.

(10) Patent No.: US 7,808,444 B2
(45) Date of Patent: Oct. 5, 2010

(54) TWO-WAY ANTENNA CONNECTOR

(75) Inventors: Joakim Eriksson, Lund (SE); Filip Jorgensen, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 873 days.

(21) Appl. No.: 11/680,718

(22) Filed: Mar. 1, 2007

(65) Prior Publication Data

US 2008/0211729 A1 Sep. 4, 2008

(51) Int. Cl.
*H01Q 1/50* (2006.01)

(52) U.S. Cl. ..... 343/860; 343/861; 343/862; 343/906

(58) Field of Classification Search ..... None
See application file for complete search history.

(56) References Cited

U.S. PATENT DOCUMENTS 3,184,693 A 5/1965 Lanctot
4,633,519 A 12/1986 Gotoh et al.
5,207,318 A 5/1993 Roland et al.
5,335,368 A * 8/1994 Tamura ..... 455/575.7
5,701,603 A * 12/1997 Norimatsu ..... 455/277.1
2005/0035921 A1* 2/2005 Huang et al. ..... 343/860

FOREIGN PATENT DOCUMENTS

EP 0 680 161 A1 11/1995

OTHER PUBLICATIONS

Written Opinion/International Search Report mailed Feb. 14, 2007, for PCT Patent Application No. PCT/IB2007/053504, filed Aug. 30, 2007, (13 pages).

* cited by examiner

*Primary Examiner*—Trinh V Dinh
(74) *Attorney, Agent, or Firm*—Harrity & Harrity, LLP

(57) ABSTRACT

A system includes a first matching network having a first impedance and a second matching network having a second impedance, where the second impedance is different than the first impedance. The system further includes a switching connector having first and second switching positions, where when the switching connector is in the first switching position an input terminal is connected through the first matching network to a first antenna and where when the switching connector is in the second switching position the input terminal is connected through the second matching network to a second antenna and the first antenna is connected to ground.

23 Claims, 8 Drawing Sheets

TWO-WAY ANTENNA CONNECTOR

TECHNICAL FIELD OF THE INVENTION

Implementations described herein relate generally to antenna matching networks and, more particularly, to an antenna connector for selectively switching a transmitter/receiver front end through either one of two different antenna matching networks.

BACKGROUND

To optimize conducted performance from a transmitter, receiver or transceiver front end module (FEM), a matching network (matching network A) is often used between the FEM and an external antenna. Because conducted performance is usually measured in a 50 ohm system, the matching network is typically optimized towards the 50 ohm load associated with the external antenna. Other antennas considered for use as an internal antenna, however, may have optimum radiation performance at a different impedance than 50 ohms. A typical solution to this problem is to place a different matching network (matching network B) in series after matching network A to try to match for optimum radiation performance. However, the restriction of including matching network A may, in most cases, decrease the power delivered to the internal antenna compared to if a match is made directly between the FEM and the internal antenna.

For example, as shown in FIG. 1, FEM 100 may connect to external antenna 110 through matching network A 120 via a connector 130 placed in a first switching position 140. FEM 100 may connect to internal antenna 150 through matching network A 120 and matching network B 160 via connector 130 placed in a second switching position 170. Since matching network A 120 has been optimized towards the 50 ohm load of the external antenna, optimization of matching network B towards the load of internal antenna 150, that is different than 50 ohms, results in a decrease of power delivery to internal antenna 150.

SUMMARY

According to one aspect, a system may include a module associated with a transmitter, receiver or transceiver. The system may further include a connector configured to selectively couple the module through a first matching network to a first antenna or through a second matching network to a second antenna, where the first matching network is different than the second matching network and wherein the first antenna is different than the second antenna.

Additionally, the connector may include a double pole, double throw switch for selectively coupling the module through the first matching network to the first antenna or through the second matching network to the second antenna.

Additionally, the first antenna may have an impedance of 50 ohms.

Additionally, the second antenna may have an impedance that is different than 50 ohms.

Additionally, the first matching network may be optimized towards a 50 ohm load.

Additionally, the second matching network may be optimized towards a load that has an impedance other than 50 ohms.

Additionally, the system may include a radiotelephone.

Additionally, when the connector couples the module through the second matching network to the second antenna, the connector couples the first antenna to ground.

Additionally, when the connector couples the module through the first matching network to the first antenna, the connector de-couples the module from the second antenna.

According to another aspect, a system may include a first matching network and a second matching network, where the first matching network is different than the second matching network. The system may further include a switching connector having first and second switching positions, where when the switching connector is in the first switching position an input terminal is connected through the first matching network to a first antenna and where when the switching connector is in the second switching position the input terminal is connected through the second matching network to a second antenna and the first antenna is connected to ground.

Additionally, the first matching network may be optimized towards a 50 ohm load.

Additionally, the second matching network may be optimized towards a load that has an impedance other than 50 ohms.

Additionally, the first antenna may have an impedance of 50 ohms and the second antenna may have an impedance of other than 50 ohms.

Additionally, a transmitter, receiver or transceiver may be connected to the input terminal.

Additionally, the switching connector may include a double pole, double throw switch.

Additionally, the system may include a radiotelephone.

According to a further aspect, a switching system may include a first single pole double throw switch and a second single pole double throw switch, where the second switch is ganged to the first switch and where when the first and second switches are in a first switching position, a transceiver circuit is connected to a first antenna via a first antenna matching network and when the first and second switches are in a second switching position, the transceiver circuit is connected to a second antenna via a second antenna matching network and the first antenna is connected to ground.

Additionally, the first antenna may be different than the second antenna and the first matching network may be different than the second matching network.

Additionally, the first antenna matching network may be optimized towards a 50 ohm load.

Additionally, the second antenna matching network may be optimized towards a load that has an impedance other than 50 ohms.

Additionally, the first antenna may have an impedance of 50 ohms and the second antenna may have an impedance of other than 50 ohms.

Additionally, the system may reside in a radiotelephone.

According to an additional aspect, a device may include a module associated with a transmitter, receiver or transceiver. The device may further include means for selectively coupling the module through a first antenna matching network to a first antenna or through a second antenna matching network to a second antenna, where the first antenna matching network may be different than the second antenna matching network and where the first antenna may be different than the second antenna.

It should be emphasized that the term "comprises/comprising" when used in this specification is taken to specify the presence of stated features, integers, steps, components or groups but does not preclude the presence or addition of one or more other features, integers, steps, components or groups thereof.

BRIEF DESCRIPTION OF THE DRAWINGS

The accompanying drawings, which are incorporated in and constitute a part of this specification, illustrate one or more embodiments of the invention and, together with the description, explain the invention. In the drawings.

DETAILED DESCRIPTION OF EMBODIMENTS

The following detailed description of the invention refers to the accompanying drawings. The same reference numbers in different drawings may identify the same or similar elements. Also, the following detailed description does not limit the invention.

Exemplary embodiments use a two-way connector for selectively coupling a transmitter, receiver or transceiver to an external antenna through a matching network that is optimized to a load of the external antenna, or to an internal antenna through a different matching network that is optimized to a load of the internal antenna. When the transmitter, receiver, or transceiver is coupled to the internal antenna, it may be only coupled through the matching network that is optimized to the load of the internal antenna, and not through the matching network optimized to the load of the external antenna. The two-way antenna connector of exemplary embodiments, thus, provides a way to present optimized matching networks both to an external (50 ohm) load and to the internal antenna directly from an output of the transmitter, receiver or transceiver. Using two different matching networks means that both conducted and radiated performance can be optimized, thus, enabling maximum power delivery to both the internal and external antenna.

Exemplary Antenna Matching System

Figure 1:
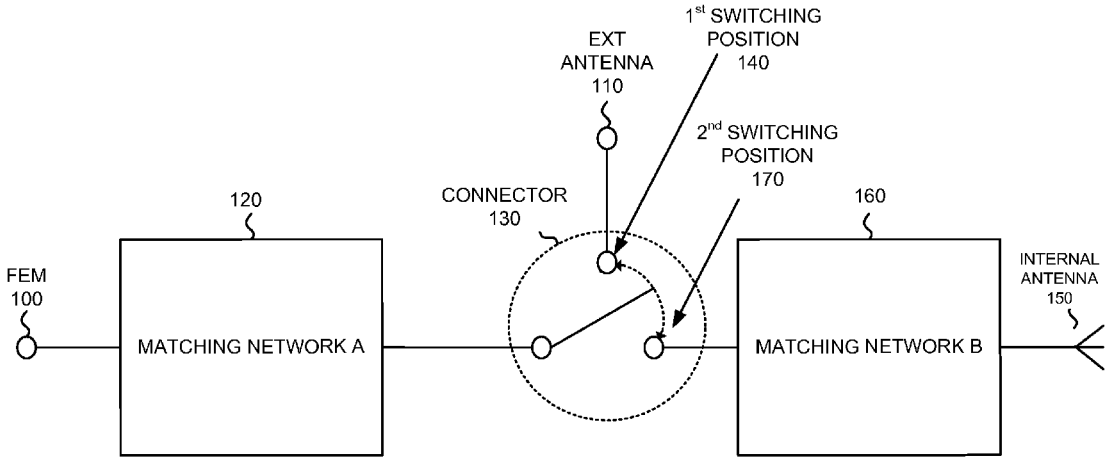
FIG. 1 PRIOR ART
FIG. 1 illustrates an existing switching system for switching between an external antenna and an internal antenna.
Figure 2A:
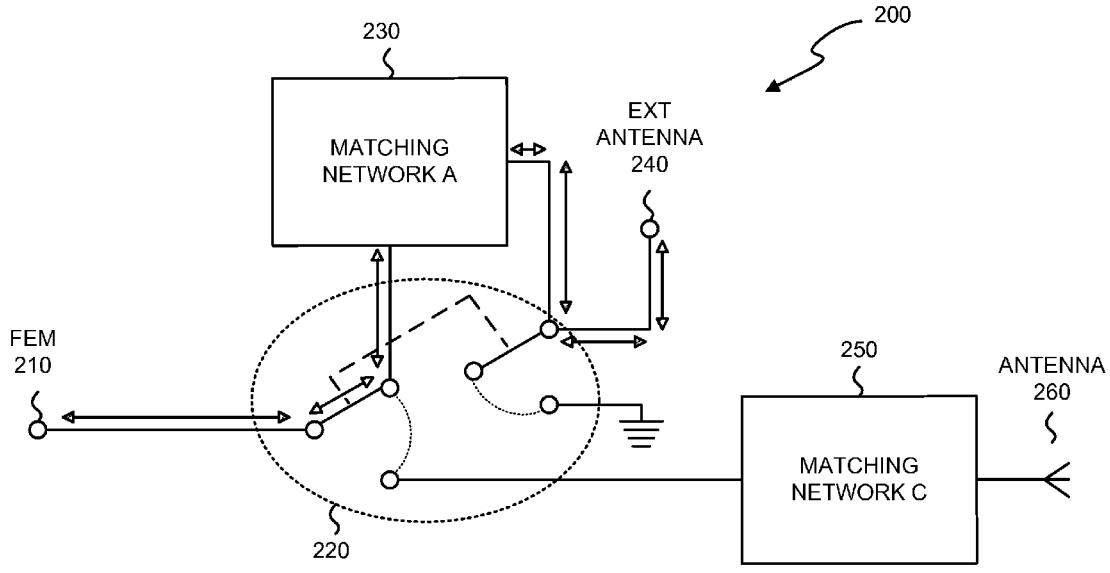
FIG. 2A illustrates a two-way connector according to an exemplary implementation placed in a first switching position which connects a front end module to an external antenna via a first matching network (A)

FIG. 2A illustrates an antenna matching system 200 for use in selectively connecting a transmitter/receiver/transceiver to a first antenna via a first antenna matching network or to a second antenna via a second antenna matching network. Antenna matching system 200 may connect a front end module 210, using a two-way connector 220, through matching network A 230 to an external antenna 240, or through matching network C 250 to an internal antenna 260. Front end module 210 may include circuitry that resides in the front end of a transmitter, receiver or transceiver unit. Matching network A 230 may include network circuitry that optimizes conducted performance to the load of external antenna 240. External antenna 240 may have, for example, a 50 ohm impedance. Matching network C 250 may include network circuitry that optimizes conducted performance to the load of internal antenna 260. Internal antenna 260 may have an impedance that is different than the impedance of external antenna 240. The optimum radiation performance of internal antenna 260, thus, occurs at a different impedance than external antenna 240.

As shown in FIG. 2A, two-way connector 220 may include a double pole double throw switch (e.g., two single pole double throw switches ganged together) that switches a connection from FEM 210 through matching network A 230 to external antenna 240, and for opening a connection from FEM 210 through matching network C 250 to antenna 260. The arrows in FIG. 2A illustrate the flow of current to/from FEM 210 and external antenna 240 when two-way connector 220 is in this first switching position.

Figure 2B:
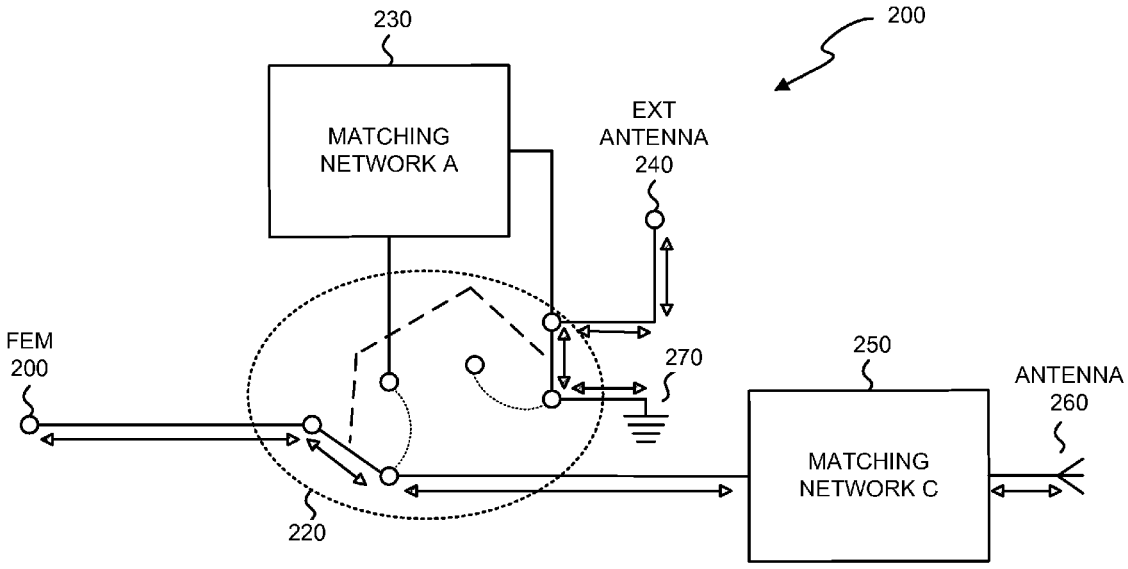
FIG. 2B illustrates the two-way connector of FIG. 2A placed in a second switching position which connects the front end module to an internal antenna via a second matching network (C) and also connects the external antenna to ground.

FIG. 2B illustrates the use of two-way connector 220 for switching a connection from FEM 210 through matching network C to antenna 260, for opening a connection from FEM 210 through matching network A 230 to external antenna 240, and for connecting external antenna 240 to ground 270. External antenna 240 is grounded in this switching position to avoid electrostatic discharge (ESD) problems. The arrows in FIG. 2B illustrate the signal transmission paths to/from FEM 210 and antenna 260 when two-way connector 220 is in this second switching position.

Exemplary Two-Way Connector

Figure 3A:
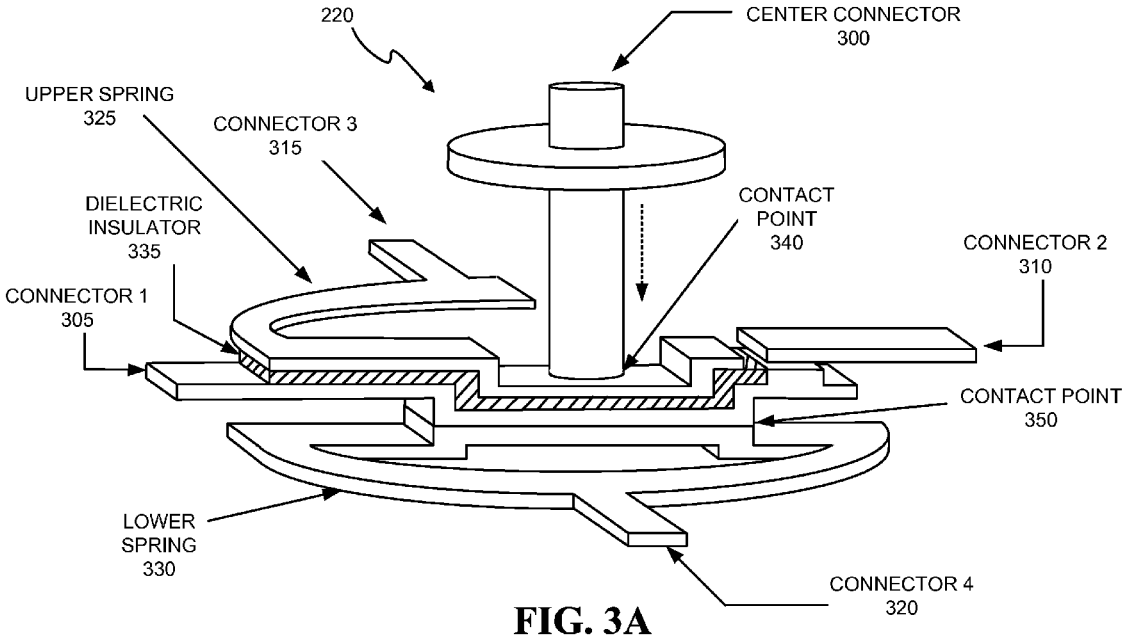
FIG. 3A illustrates one physical implementation of the two-way connector of FIG. 2A in which the two-way connector is in a first switching position.

FIG. 3A illustrates a physical configuration of one exemplary implementation of two-way connector 220. In the exemplary implementation shown, two-way connector 220 may include a center connector 300, a first connector 305, a second connector 2 310, a third connector 315, a fourth connector 320, an upper spring 325, a lower spring 330 and a dielectric insulator 335. Center connector 300, connector 1 305, connector 2 310, connector 3 315 and connector 4 320 may include an electrically conductive material(s). Dielectric insulator 335 may include an elastic, electrically non-conductive material that insulates connector 1 305 from connector 3 315, and which may bend along with a displacement of upper spring 325.

As depicted in FIG. 3A, center connector 300 may include a disc-shaped electrical contact formed on a cylindrical shaft that may move vertically up (i.e., away from connector 3 315) and down (towards connector 3 315). Center connector 300 may move up to contact a two-way connector housing (not shown in FIG. 3A) which is grounded or move down to contact connector 3 315 via a contact point 340. Moving center connector 300 downwards also moves connector 1 305, via displacement of upper spring 325, into contact with connector 4 320 via a contact point 350, as shown in FIG. 3A. Moving center connector 300 downwards also moves connector 1 305, via displacement of upper spring 325, to break contact with connector 2 310, as further shown in FIG. 3A. FIG. 3A illustrates two-way connector 210 in a first switching position in which center connector 300 has been moved downwards to contact connector 3 315 via contact point 340, further causing connector 1 305 to move into contact with connector 4 320 via contact point 350, and also causing connector 1 305 to break contact with connector 2 310.

Figure 3B:
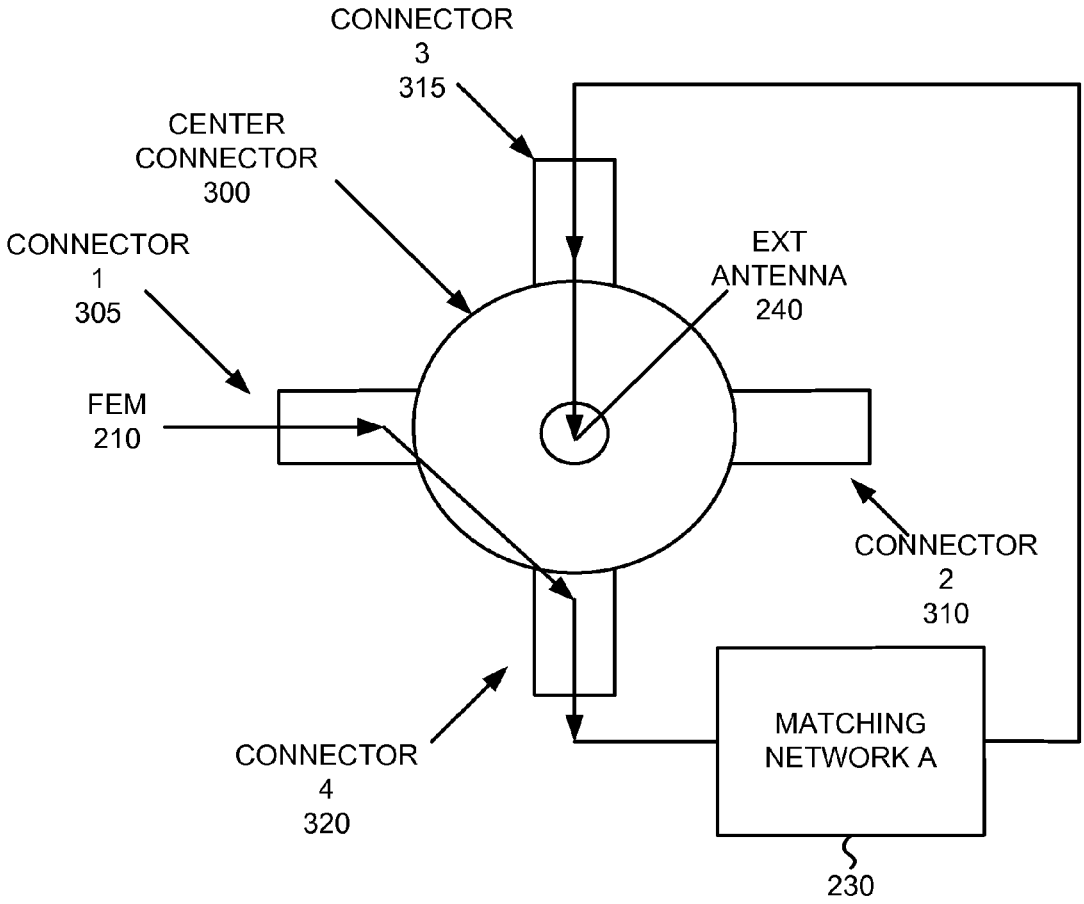
FIG. 3B illustrates another view of the two-way connector of FIG. 3A that depicts the front end module being connected to the external antenna through matching network A.

FIG. 3B is another view of two-way connector 220 depicting center connector 300 moved downwards such that connector 1 305 contacts with connector 4 320 and contact between connector 1 305 and connector 2 310 is broken. As shown in FIG. 3B, when two-way connector 220 is in this switching position, FEM 210 connects to matching network A 230 via connector 1 305 and connector 4 320, and matching network A 230 connects to external antenna connector 240 via connector 3 315 and center connector 300.

Figure 4A:
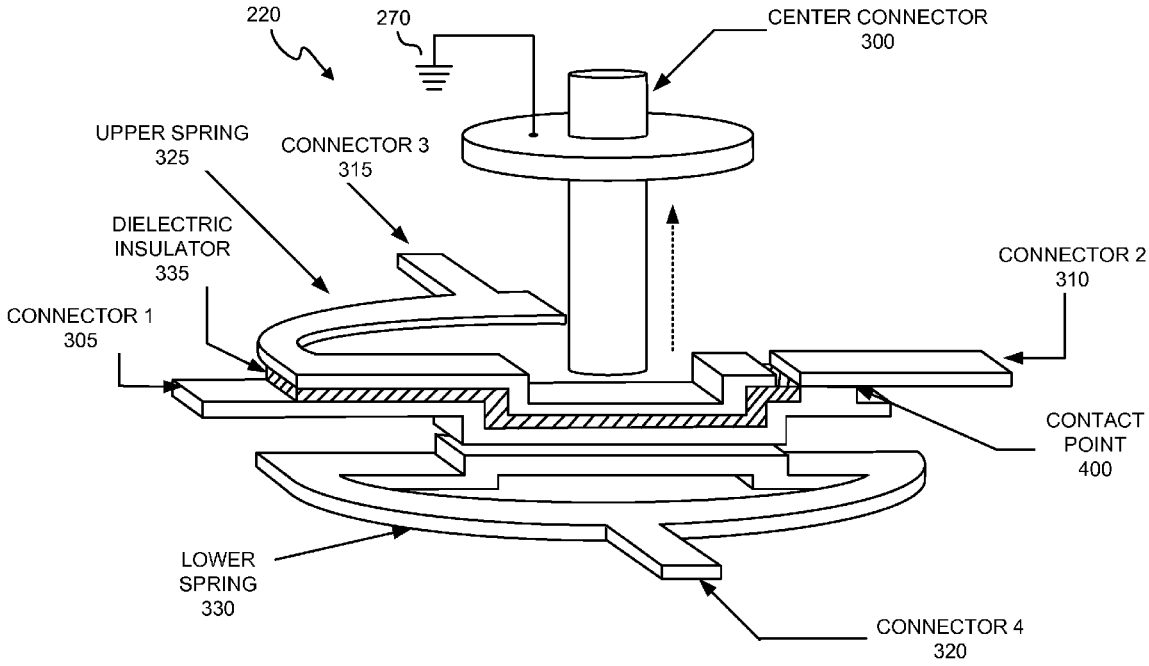
FIG. 4A illustrates the physical implementation of FIG. 3A of the two-way connector in which the two-way connector is in a second switching position.

FIG. 4A illustrates two-way connector 220 in a second switching position in which center connector 300 has been moved upwards to contact ground contact 270, further causing connector 1 305 to move into contact with connector 2 310 via contact point 400, and causing connector 1 305 to break contact with connector 4 320.

Figure 4B:
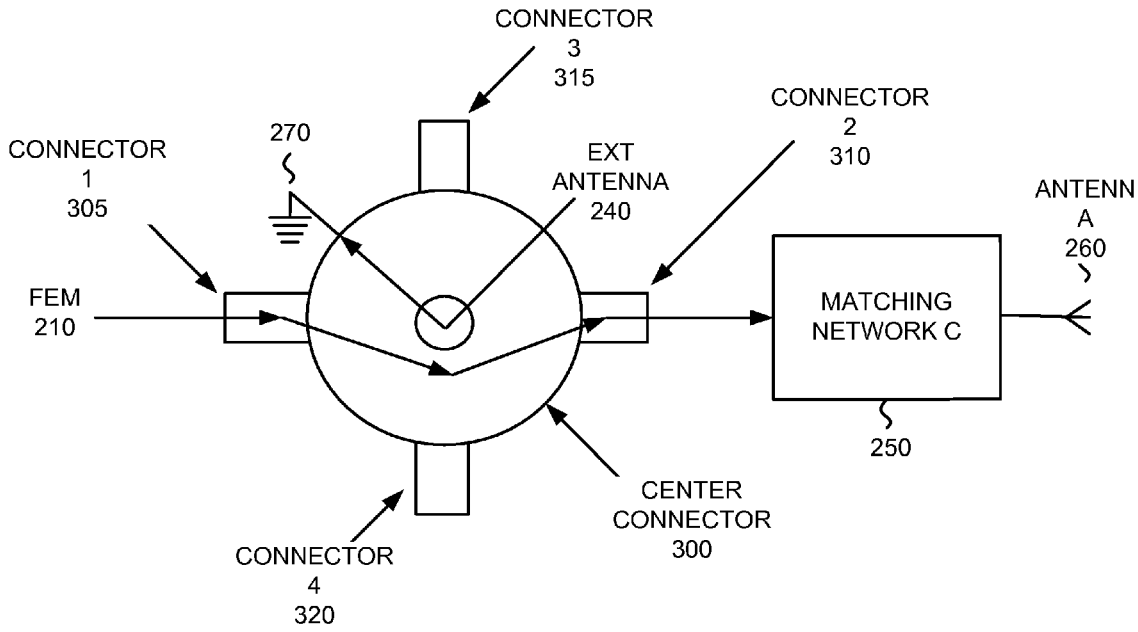
FIG. 4B illustrates another view of the two-way connector of FIG. 4A that depicts the front end module being connected to the internal antenna through matching network C.

FIG. 4B is another view of two-way connector 220 depicting center connector 300 moved upwards such that center connector 300 has contacted ground contact 270, connector 1 305 has moved into contact with connector 2 310 via contact point 400, and connector 1 305 has broken contact with connector 4 320. As shown in FIG. 4B, when two-way connector 220 is in this switching position, FEM 210 connects to matching network C 250 via connector 1 305 and connector 2 310, and external antenna connector 240 connects to ground contact 270 via center connector 300.

Exemplary Communication Device Using Two-Way Connector

Figure 5:
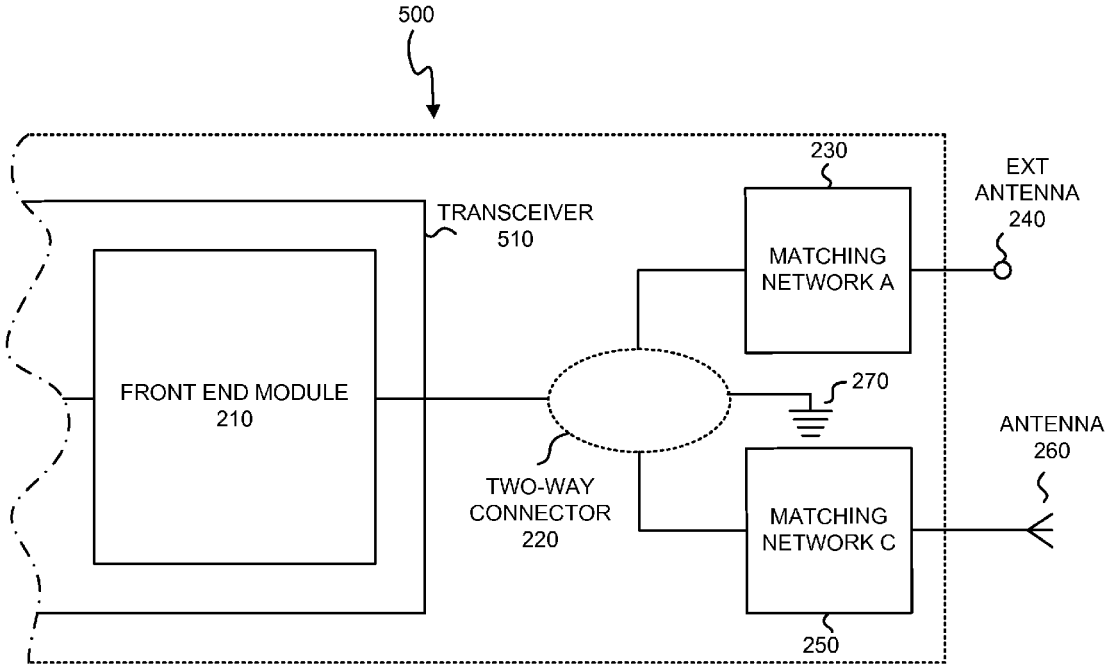
FIG. 5 depicts use of the two-way connector of FIGS. 2A and 2B within a communications device.

FIG. 5 illustrates a communication device 500 that uses two-way connector 220. Communication device 500 may include any type of radio-communication device. For example, in one implementation, communication device 500 may include a cellular radiotelephone.

As shown, device 500 may include a front end module 210 of a transceiver 510 that is connected to two-way connector 220. Two-way connector 220 may further be connected to matching network A, to ground 270 and to matching network C 250. When two-way connector 220 is in the first switching position shown in FIG. 2A, front end module 210 may be coupled to external antenna 240 via matching network A 230. When two-way connector 220 is in the second switching position shown in FIG. 2B, front end module 210 may be coupled to internal antenna 260 via matching network C 250, and external antenna 240 may be connected to ground 270.

CONCLUSION

A two-way connector, as described herein, selectively couples a transmitter, receiver or transceiver to an external antenna through a matching network that is optimized to a load of the external antenna, or to an internal antenna through a different matching network that is optimized to a load of the internal antenna. The two-way antenna connector, thus, presents optimized matching networks to an external antenna that has an impedance of, for example, 50 ohms and to an internal antenna that has a different impedance than the external antenna. The two-way connector enables the use of two different antenna matching networks such that both conducted and radiated performance are matched to optimum, enabling maximum power delivery to both the internal and external antenna.

The foregoing description of implementations provides illustration and description, but is not intended to be exhaustive or to limit the invention to the precise form disclosed. Modifications and variations are possible in light of the above teachings, or may be acquired from practice of the invention.

No element, act, or instruction used in the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A system, comprising:

a module associated with a transmitter, a receiver, or a transceiver; and a connector to selectively couple the module through a first matching network to a first antenna, when the connector is in a first position, and couple the module through a second matching network to a second antenna, when the connector is in a second position, where the first matching network is different than the second matching network, where the first antenna is different than the second antenna, where the first matching network is optimized towards a first load that has a first impedance associated with an impedance of the first antenna, and where the second matching network is optimized towards a second load that has a second, different impedance associated with an impedance of the second antenna.

2. The system of claim 1, where the connector includes a double pole, double throw switch for selectively coupling the module through the first matching network to the first antenna or through the second matching network to the second antenna.

3. The system of claim 1, where the impedance of the first antenna is 50 ohms.

4. The system of claim 3, where the impedance of the second antenna is different than 50 ohms.

5. The system of claim 1, where the first impedance is 50 ohms.

6. The system of claim 1, where the second impedance is different than 50 ohms.

7. The system of claim 1, where the system comprises a radiotelephone.

8. The system of claim 1, where, when the connector couples the module through the second matching network to the second antenna, the connector couples the first antenna to ground.

9. The system of claim 1, where, when the connector couples the module through the first matching network to the first antenna, the connector de-couples the module from the second antenna.

10. A system, comprising:

a first matching network;

a second matching network, where the first matching network is different than the second matching network; and a switching connector having a first switching position and a second switching position, where, when the switching connector is in the first switching position, an input terminal is connected through the first matching network to a first antenna, where, when the switching connector is in the second switching position, the input terminal is connected through the second matching network to a second antenna and the first antenna is connected to ground, where the first matching network is optimized towards a first impedance of a first load, and where the second matching network is optimized towards a second, different impedance of a second load.

11. The system of claim 10, where the first impedance is 50 ohms.

12. The system of claim 11, where the second, different impedance is different than 50 ohms.

13. The system of claim 10, where the first antenna has an impedance of 50 ohms, and where the second antenna has an impedance different than 50 ohms.

14. The system of claim 10, where a transmitter, a receiver, or a transceiver is connected to the input terminal.

15. The system of claim 10, where the switching connector comprises a double pole, double throw switch.

16. The system of claim 10, where the system comprises a radiotelephone.

17. A switching system, comprising:

a first single pole double throw switch;

a second single pole double throw switch, where the second single pole double throw switch is ganged to the first single pole double throw switch, where, when the first single pole double throw switch and the second single pole double throw switch are in a first switching position, a transceiver circuit is connected to a first antenna via a first antenna matching network, where, when the first single pole double throw switch and the second single pole double throw switch are in a second switching position, the transceiver circuit is connected to a second antenna via a second antenna matching network and the first antenna is connected to ground, where the first antenna matching network is optimized towards a first impedance of a first load, and where the second antenna matching network is optimized towards a second impedance of a second, different load.

18. The system of claim 17, where the first antenna is different than the second antenna, and where the first matching network is different than the second matching network.

19. The system of claim 17, where the first impedance, of the first load, is 50 ohms.

20. The system of claim 19, where the second impedance, of the second, different load, is different than 50 ohms.

21. The system of claim 17, where the first antenna has an impedance of 50 ohms, and where the second antenna has an impedance different than 50 ohms.

22. The system of claim 17, where the system resides in a radiotelephone.

23. A device, comprising:

a module associated with a transmitter, a receiver, or a transceiver; and means for selectively coupling the module through a first antenna matching network to a first antenna, or through a second antenna matching network to a second antenna, where the first antenna matching network is different than the second antenna matching network, where the first antenna is different than the second antenna, where the first antenna matching network is optimized towards a first load that has a first impedance associated the first antenna, and where the second antenna matching network is optimized towards a second load that has a second, different impedance associated with the second antenna.

* * * * *